US010300581B2

(12) United States Patent
Schillo-Armstrong et al.

(10) Patent No.: US 10,300,581 B2
(45) Date of Patent: May 28, 2019

(54) METHODS OF MAKING ABRASIVE ARTICLES AND BONDED ABRASIVE WHEEL PREPARABLE THEREBY

(71) Applicant: 3M INNOVATIVE PROPERTIES COMPANY, St. Paul, MN (US)

(72) Inventors: Melissa C. Schillo-Armstrong, Stillwater, MN (US); Scott R. Culler, Burnsville, MN (US); Brian D. Goers, Minneapolis, MN (US); Roger J. Eicheldinger, Inver Grove Heights, MN (US); Negus B. Adefris, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/510,562

(22) PCT Filed: Sep. 14, 2015

(86) PCT No.: PCT/US2015/049978
§ 371 (c)(1),
(2) Date: Mar. 10, 2017

(87) PCT Pub. No.: WO2016/044158
PCT Pub. Date: Mar. 24, 2016

(65) Prior Publication Data

US 2017/0252898 A1 Sep. 7, 2017

Related U.S. Application Data

(60) Provisional application No. 62/050,483, filed on Sep. 15, 2014.

(51) Int. Cl.
*B24D 7/08* (2006.01)
*B24D 18/00* (2006.01)
(Continued)

(52) U.S. Cl.
CPC ..... *B24D 7/08* (2013.01); *B24D 3/001* (2013.01); *B24D 3/004* (2013.01); *B24D 3/28* (2013.01);
(Continued)

(58) Field of Classification Search
CPC ..... B24D 18/0072; B24D 3/001; B24D 7/08; B24D 11/001; B24D 18/0009;
(Continued)

(56) References Cited

U.S. PATENT DOCUMENTS 1,910,444 A 5/1933 Nicholson
3,041,156 A 6/1962 Rowse
(Continued)

FOREIGN PATENT DOCUMENTS

CN 1651193 A 8/2005
CN 1882418 A 12/2006
(Continued)

OTHER PUBLICATIONS

International Search Report for PCT International Application No. PCT/US2015/049978, dated Dec. 22, 2015, 4 pages.
(Continued)

*Primary Examiner* — Marc Carlson
(74) *Attorney, Agent, or Firm* — Katherine M. Scholz; Bradford B. Wright

(57) ABSTRACT

Methods of making abrasive articles involve adhering shaped abrasive particles to a reinforcing member according to a predetermined pattern and optionally orientation, and depositing a space-filling binder precursor on the reinforcing member and shaped abrasive particles to provide a filled abrasive preform, disposing another reinforcing member onto the filled abrasive preform, and curing the abrasive article precursor to form the abrasive articles. In some aspects, multiple abrasive preforms are stacked on each
(Continued)

other. Bonded abrasive wheels preparable according to the methods are also disclosed.

20 Claims, 7 Drawing Sheets

(51) Int. Cl.

| | |
|---|---|
| ***B24D 3/00*** | (2006.01) |
| ***B24D 3/28*** | (2006.01) |
| ***B24D 5/04*** | (2006.01) |
| ***B24D 5/06*** | (2006.01) |
| ***B24D 5/12*** | (2006.01) |
| ***B24D 11/00*** | (2006.01) |

(52) U.S. Cl.
CPC ..... *B24D 5/04* (2013.01); *B24D 5/06* (2013.01); *B24D 5/12* (2013.01); *B24D 11/001* (2013.01); *B24D 18/0009* (2013.01); *B24D 18/0072* (2013.01)

(58) Field of Classification Search
CPC . B24D 3/004; B24D 3/28; B24D 5/04; B24D 5/06; B24D 5/12
See application file for complete search history.

(56) References Cited

U.S. PATENT DOCUMENTS

| | | | | |
|---|---|---|---|---|
| 4,314,827 | A | 2/1982 | Leitheiser | |
| 4,623,364 | A | 11/1986 | Cottringer | |
| 4,652,275 | A | 3/1987 | Bloecher | |
| 4,744,802 | A | 5/1988 | Schwabel | |
| 4,770,671 | A | 9/1988 | Monroe | |
| 4,799,939 | A | 1/1989 | Bloecher | |
| 4,881,951 | A | 11/1989 | Wood | |
| 4,997,461 | A | 3/1991 | Markhoff-Matheny | |
| 5,009,675 | A | 4/1991 | Kunz | |
| 5,011,508 | A | 4/1991 | Wald | |
| 5,042,991 | A | 8/1991 | Kunz | |
| 5,049,165 | A | 9/1991 | Tselesin | |
| 5,085,671 | A | 2/1992 | Martin | |
| 5,092,910 | A | 3/1992 | Dekok | |
| 5,152,917 | A | 10/1992 | Pieper | |
| 5,201,916 | A | 4/1993 | Berg | |
| 5,213,591 | A | 5/1993 | Celikkaya | |
| 5,219,462 | A | 6/1993 | Bruxvoort | |
| 5,251,802 | A | 10/1993 | Bruxvoort | |
| 5,304,223 | A | 4/1994 | Pieper | |
| 5,352,254 | A | 10/1994 | Celikkaya | |
| 5,366,523 | A | 11/1994 | Rowenhorst | |
| 5,372,620 | A | 12/1994 | Rowse | |
| 5,380,390 | A | 1/1995 | Tselesin | |
| 5,435,816 | A | 7/1995 | Spurgeon | |
| 5,453,106 | A | 9/1995 | Roberts | |
| 5,500,273 | A * | 3/1996 | Holmes | B24D 3/28 428/147 |
| 5,549,962 | A | 8/1996 | Holmes | |
| 5,560,745 | A | 10/1996 | Roberts | |
| 5,620,489 | A | 4/1997 | Tselesin | |
| RE35,570 | E | 7/1997 | Rowenhorst | |
| 5,672,097 | A | 9/1997 | Hoopman | |
| 5,695,533 | A | 12/1997 | Kardys | |
| 5,876,470 | A * | 3/1999 | Abrahamson | B24D 3/00 51/307 |
| 5,946,991 | A | 9/1999 | Hoopman | |
| 5,975,987 | A | 11/1999 | Hoopman | |
| 5,975,988 | A | 11/1999 | Christianson | |
| 5,984,988 | A | 11/1999 | Berg | |
| 6,129,540 | A | 10/2000 | Hoopman | |
| 6,286,498 | B1 | 9/2001 | Sung | |
| 6,537,140 | B1 * | 3/2003 | Miller | B24D 11/00 451/259 |
| 6,669,745 | B2 | 12/2003 | Prichard | |
| 6,702,650 | B2 | 3/2004 | Adefris | |
| 7,553,346 | B2 | 6/2009 | Welygan | |
| 8,038,750 | B2 | 10/2011 | Pribyl | |
| 8,080,273 | B2 | 12/2011 | Lykomitros | |
| 8,083,820 | B2 | 12/2011 | Kollodge | |
| 8,142,531 | B2 | 3/2012 | Adefris | |
| 8,142,532 | B2 | 3/2012 | Erickson | |
| 8,142,891 | B2 | 3/2012 | Culler | |
| 8,425,278 | B2 | 4/2013 | Culler | |
| 9,662,766 | B2 * | 5/2017 | Schwabel | B24B 27/0675 |
| 2007/0000214 | A1 * | 1/2007 | Schwabel | B24D 5/12 53/472 |
| 2009/0165394 | A1 | 7/2009 | Culler | |
| 2009/0169816 | A1 | 7/2009 | Erickson | |
| 2010/0048112 | A1 | 2/2010 | Lee | |
| 2011/0289855 | A1 | 12/2011 | Axinte | |
| 2012/0227333 | A1 | 9/2012 | Adefris | |
| 2013/0040537 | A1 * | 2/2013 | Schwabel | B24D 5/04 451/28 |
| 2013/0125477 | A1 | 5/2013 | Adefris | |
| 2013/0203328 | A1 * | 8/2013 | Givot | B24D 5/02 451/548 |
| 2013/0344786 | A1 * | 12/2013 | Keipert | B24D 3/28 451/529 |
| 2014/0106126 | A1 | 4/2014 | Gaeta | |
| 2014/0287654 | A1 * | 9/2014 | Schwabel | B24B 27/0675 451/28 |

FOREIGN PATENT DOCUMENTS

| | | |
|---|---|---|
| WO | WO 99/22913 A1 | 5/1999 |
| WO | WO 2011-109188 | 9/2011 |
| WO | WO 2012-112305 | 8/2012 |
| WO | WO 2013-036402 | 3/2013 |
| WO | WO 2013-045251 | 4/2013 |
| WO | WO 2013-070576 | 5/2013 |
| WO | WO 2014-209567 | 12/2014 |
| WO | WO 2015-050781 | 4/2015 |
| WO | WO 2015-100018 | 7/2015 |
| WO | WO 2015-100020 | 7/2015 |
| WO | WO 2015-100220 | 7/2015 |

OTHER PUBLICATIONS

Extended European Search Report, EP15842922.5, dated Apr. 23, 2018, 3 pages.

* cited by examiner

METHODS OF MAKING ABRASIVE ARTICLES AND BONDED ABRASIVE WHEEL PREPARABLE THEREBY

TECHNICAL FIELD

The present disclosure broadly relates to abrasive articles and methods of making them.

BACKGROUND

Bonded abrasive articles have abrasive particles retained in a binder (also known in the art as a bonding medium) that bonds them together as a shaped mass. Examples of typical bonded abrasives include grinding wheels, stones, hones, and cut-off wheels. The binder can be an organic resin, a ceramic or glassy material (both known in the art as examples of a vitreous binder), or a metal.

Cut-off wheels are typically relatively thin wheels used for general cutting operations. The wheels are typically about 1 to about 200 centimeters in diameter, and several millimeters to several centimeters thick (with greater thickness for the larger diameter wheels). They may be operated at speeds from about 1000 to 50000 revolutions per minute, and are used for operations such as cutting polymer, composite metal, or glass, for example, to nominal lengths. Cut-off wheels are also known as "industrial cut-off saw blades" and, in some settings such as foundries, as "chop saws". As their name implies, cut-off wheels are use to cut stock such as, for example, metal rods, by abrading through the stock.

There is a continuing need for new bonded abrasives that have improved abrading properties and/or reduced cost at the same performance level.

SUMMARY

In a first aspect the present disclosure provides a method of making an abrasive article, the method comprising steps:

a) providing a positioning tool having a working surface with cavities formed therein, wherein the cavities are arranged on the working surface according to a pattern and orientation;
b) making an abrasive preform comprising shaped abrasive particles adhered to a first reinforcing member having opposed front and back surfaces, and wherein the abrasive preform is made by a method comprising:
   i) disposing the shaped abrasive particles in at least some of the cavities of the positioning tool;
   ii) transferring the shaped abrasive particles to the first reinforcing member that shaped abrasive particles are disposed proximate to the front surface of the first reinforcing member according to the pattern of the cavities;
   iii) adhering the transferred shaped abrasive particles to the front surface of the first reinforcing member; and
   iv) depositing a space-filling binder precursor on the first reinforcing member and transferred shaped abrasive particles such that space between the shaped abrasive particles is at least partially filled with the space-filling binder precursor;
c) disposing a second reinforcing member on the abrasive preform wherein the front surface of the first reinforcing member faces said second reinforcing member to provide an abrasive article precursor; and
d) compressing and curing the abrasive article precursor to form the abrasive article.

In another aspect, the present disclosure provides a method of making an abrasive article, the method comprising steps:

a) providing a positioning tool having a working surface with cavities formed therein, wherein the cavities are arranged on the working surface according to a pattern;
b) making a plurality of abrasive preforms, wherein each abrasive preform respectively comprises shaped abrasive particles adhered to a first reinforcing member, and wherein each abrasive preform is respectively made by a method comprising:
   i) disposing shaped abrasive particles in at least some of the cavities of the positioning tool;
   ii) transferring the shaped abrasive particles to a first reinforcing member having front and back surfaces such that shaped abrasive particles are disposed on the front surface of the first reinforcing member according to the pattern of the cavities;
   iii) adhering the transferred shaped abrasive particles to the front surface of the first reinforcing member;
   iv) depositing a space-filling binder precursor onto the first reinforcing member and transferred shaped abrasive particles such that space between shaped abrasive particles is at least partially filled with the space-filling binder precursor;
d) forming a stack comprising the plurality of abrasive preforms, wherein the stack has a top and a bottom, thereby providing an abrasive article precursor; and
e) curing the abrasive article precursor while compressing the plurality of abrasive preforms together to form the abrasive article.

Methods according to the present disclosure are useful for making abrasive articles.

Accordingly, in another aspect, the present disclosure provides an abrasive wheel comprising precisely-shaped abrasive particles retained in an organic binder material, wherein the abrasive wheel comprises two sides contacting a peripheral surface, wherein the abrasive wheel has a rotational axis extending through its center, wherein at least a portion of the precisely-shaped abrasive particles are disposed in the organic binder material according to a predetermined three-dimensional position and orientation, wherein the precisely-shaped abrasive particles comprise a base and a top connected by a plurality of sidewalls, and wherein the respective bases of the shaped abrasive particles are aligned substantially perpendicular to the rotational axis.

As used herein, the term "phenolic resin" refers to a synthetic thermosetting resin obtained by the reaction of at least one phenol (e.g., phenol, resorcinol, m-cresol, 3,5-xylenol, t-butylphenol, and/or p-phenylphenol) with at least one aldehyde (e.g., formaldehyde, acetaldehyde, chloral, butyraldehyde, furfural, and/or acrolein).

As used herein, the term "shaped abrasive particle" refers to an abrasive particle with at least a portion of the abrasive particle having an intentionally created shape imparted through a shaping process during manufacture. Shaped abrasive particle, as used herein, excludes randomly sized abrasive particles obtained by a mechanical crushing operation. Non-limiting processes to make shaped abrasive particles include shaping precursor abrasive particles in a mold having a predetermined shape, extruding the precursor abrasive particle through an orifice having a predetermined shape, printing the precursor abrasive particle though an opening in a printing screen having a predetermined shape, or embossing the precursor abrasive particle into a predetermined shape or pattern. Non-limiting examples of shaped abrasive particles include shaped abrasive particles formed in a mold, such as triangular plates as disclosed in U.S. Pat. Nos. RE 35,570 (Rowenhorst et al.); U.S. Pat. No. 5,201,916 (Berg et al.), and U.S. Pat. No. 5,984,988 (Berg et al.); or extruded elongated ceramic rods/filaments often having a circular cross section produced by Saint-Gobain Abrasives an example of which is disclosed in U.S. Pat. No. 5,372,620 (Rowse et al.). Shaped abrasive particle, as used herein, excludes randomly sized abrasive particles obtained by a mechanical crushing operation.

As used herein, the term "precisely-shaped" in reference to abrasive particles or cavities in a positioning tool or frame refers to abrasive particles or cavities having a three-dimensional shape that is defined by relatively smooth-surfaced sides that are bounded and joined by well-defined sharp edges having distinct edge lengths with distinct endpoints defined by the intersections of the various sides. The term "precisely-shaped abrasive particles" thus excludes ceramic abrasive particles obtained by a conventional mechanical crushing operation.

Features and advantages of the present disclosure will be further understood upon consideration of the detailed description as well as the appended claims.

Figure 1:
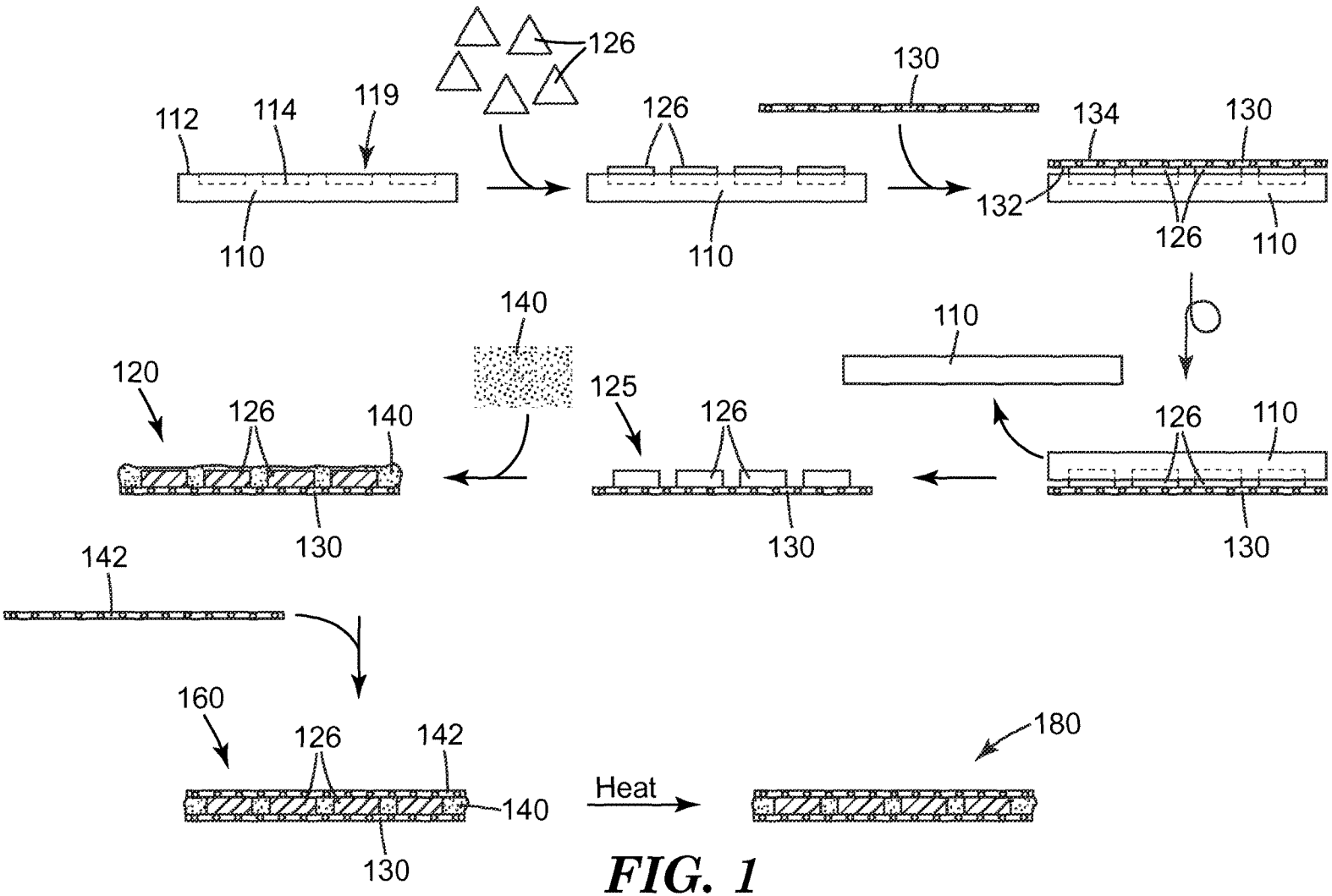
FIG. 1 is a schematic process flow diagram of a method of making an abrasive article according to one embodiment of the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

One exemplary embodiment of a method of making an abrasive article 180 according to the present disclosure is shown in FIG. 1.

First, a positioning tool 110 is provided. Positioning tool 110 has working surface 112 with cavities 114 formed therein which are arranged on working surface 112 according to a predetermined pattern 119 and orientation. In some preferred embodiments, the cavities in the positioning tool working surface have planar faces that meet along sharp edges, and form the sides and top of truncated pyramids (e.g., truncated trigonal pyramids).

Useful positioning tools may have the cavities arranged according to any pattern and, optionally, orientation (e.g., in the case of cavities having straight sides). The cavities may be arranged randomly, pseudo-randomly, or according to a regular array circular, rectangular, or hexagonal array, for example. In some embodiments, especially useful for making abrasive wheels, the cavities may be arranged such that they are circumferentially staggered so that abrasive particles are always located at any radial distance from the rotational axis of the wheel.

A polymeric positioning tool can be replicated off a metal master tool. The master tool will have the inverse pattern desired for the positioning tool. In one embodiment, the master tool is made out of metal, e.g., nickel and is diamond turned. The master tool and/or the positioning tool can be a belt, a sheet, a continuous web, a coating roll such as a rotogravure roll, a sleeve mounted on a coating roll or die.

A polymeric sheet material can be heated along with the master tool such that the polymeric material is embossed with the inverse of the master tool pattern by pressing the two together. A polymeric or thermoplastic material can also be extruded or cast onto the master tool and then pressed. The thermoplastic material is cooled to solidify and produce the positioning tool. If a thermoplastic positioning tool is utilized, then care should be taken not to generate excessive heat that may distort the thermoplastic positioning tool limiting its life.

Examples of suitable polymeric materials include thermoplastics such as polyesters, polycarbonates, poly(ether sulfone), poly(methyl methacrylate), polyurethanes, polyvinylchloride, polyolefins (e.g., polyethylene and polypropylene), polystyrene, thermosetting materials, and combinations thereof. In one embodiment, the entire positioning tooling is made from a polymeric material. In another embodiment, the surfaces of the positioning tooling in contact with sol-gel (e.g., a boehmite sol-gel) while drying, such as the surfaces of the plurality of cavities, comprise polymeric materials and other portions of the positioning tooling can be made from other materials.

Figure 2A:
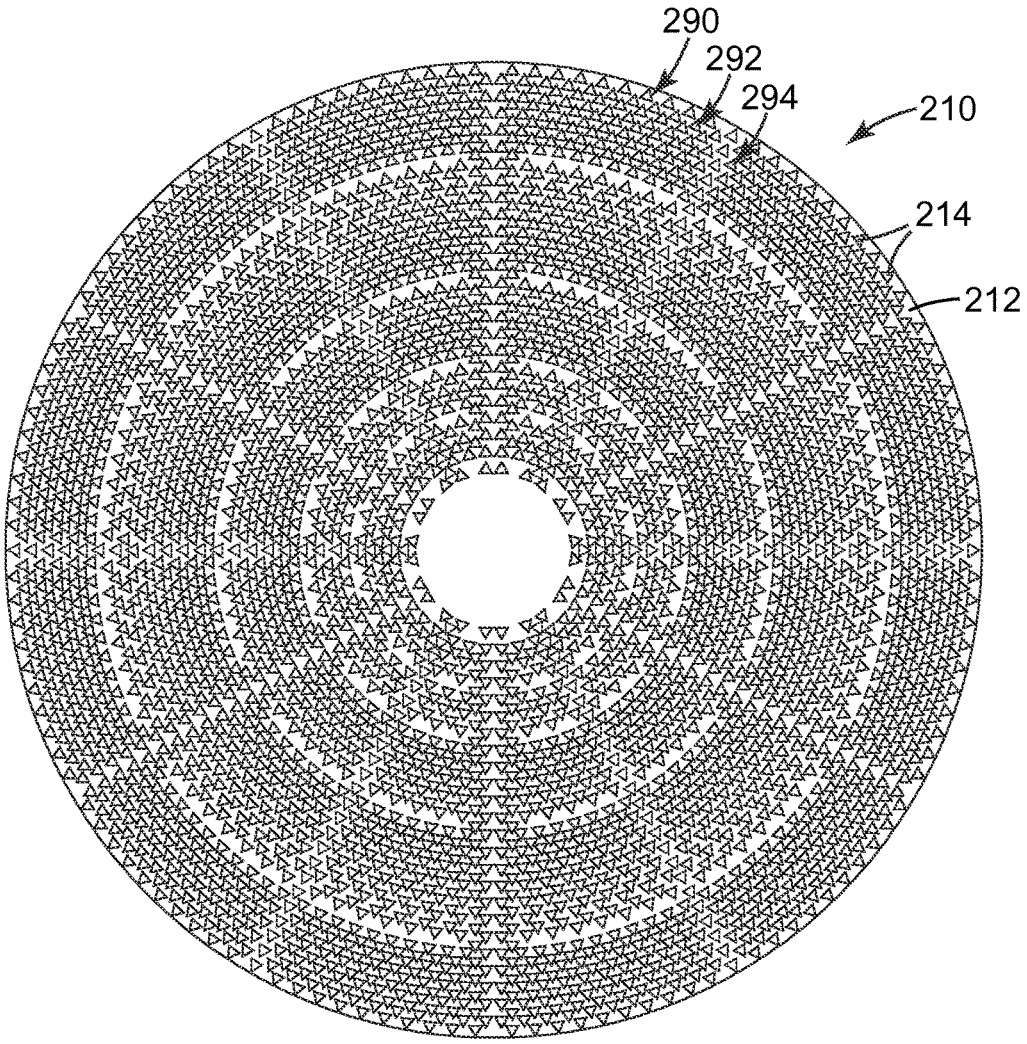
FIG. 2A is a schematic plan view of an exemplary positioning tool 210.

FIG. 2A shows an exemplary positioning tool 210 with cavities 214 at working surface 212, shaped as truncated trigonal pyramids, and arranged according to a first predetermined pattern and orientation. Radially overlapping circumferential rows 290. 292, 294 are arranged such that in the resultant abrasive article, abrasion from the outer circumferential edge exposes a fresh abrasive particle to the abrading surface prior to exhaustion of the outer circumferential row of abrasive particles.

Figure 2B:
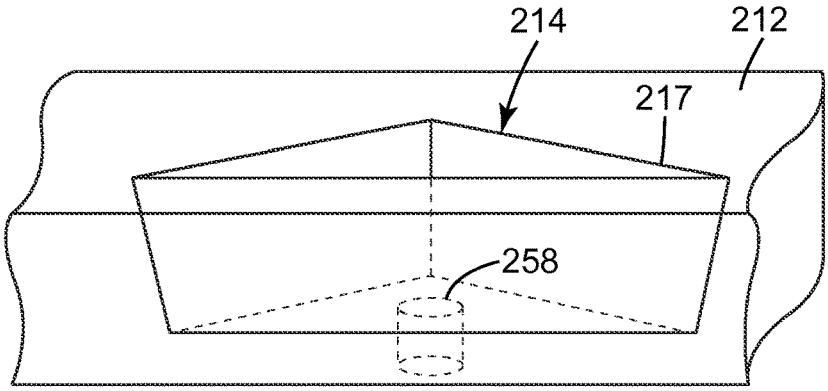
FIG. 2B is a schematic perspective view of cavity 214 in FIG. 2A.

FIG. 2B shows cavity 214 with opening 217 and optional conduit 258 extending away from working surface 212 of positioning tool 210 toward a source of reduced pressure (not shown).

Further information concerning the design and fabrication of positioning tools and master tools, and patterns of cavities, can be found in U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.).

Referring again to FIG. 1, positioning tool 110 is used to make abrasive preform 125 comprising abrasive particles 126 adhered to first reinforcing member 130 having front and back surfaces (132, 134). Abrasive preform 125 can be made by disposing abrasive particles 126 in cavities 114 of positioning tool 110, adhering the abrasive particles 126 to first reinforcing member 130, and removing positioning tool 110. Space-filling binder precursor 140 is then deposited onto the first reinforcing member 130 and transferred abrasive particles 126 such that space between the abrasive particles is at least partially filled with the space-filling binder precursor resulting in filled abrasive preform 120.

The abrasive particles may be placed into the cavities in their entirety or only partially, as desired. Any filling technique may be use including manual filling, vibratory filling, blowing, and suction. Shaking the abrasive frame, wiping the surface of the frame with a brush, and/or blowing with on it with compressed gas (e.g., air or nitrogen) may be useful for removal of extraneous particles not residing with the cavities from becoming incorporated in the resultant abrasive articles.

Abrasive particles 126 are transferred to first reinforcing member 130 such that abrasive particles 126 are disposed on front surface 132 according to predetermined pattern 119 and then adhered. This step may be carried out, for example, by placing the front surface of the first reinforcing member on top of the abrasive particles in the cavities of positioning tool to form an assembly, clamping the assembly together, flipping the assembly over such that the first reinforcing member is on the bottom facing up, then removing the positioning tool, and leaving behind abrasive particles with a predetermined position and orientation.

In some embodiments, adhesion is achieved by depositing a thin coating of a liquid binder precursor on the surface of the shaped abrasive particles; and then adhering the particulate binder precursor to the thin coating of a liquid binder precursor, prior to placing them in the positioning tool. Heating softens the particulate binder precursor and adheres it to the reinforcing member. Alternatively, or in addition, the front surface of the reinforcing member may have a curable adhesive precursor disposed on at least a portion thereof (e.g., which may be tacky or heat softenable) that provides adhesion to the reinforcing member. If used, the curable adhesive precursor is preferably a liquid, although it may comprise an A-staged or B-staged tacky resin.

Space-filling binder precursor 140 is then disposed on at least a portion of the surfaces of abrasive particles 126 and surface 132 of reinforcing member 130 (e.g., depicted as a scrim). Space-filling binder precursor 140 contains a cured (i.e., covalently crosslinked) organic thermosetting resin. Examples of thermosetting resins are described hereinabove. Preferably, the thermosetting organic resin comprises at least one phenolic resin (e.g., novolac and/or resole). The organic binder material typically, but optionally, also contains one or more additives known for use in resin bond abrasive articles. Examples include grinding aids, lubricants, antistatic agents, and fillers; for example, as described hereinbelow.

Cavities 114 have predetermined shapes (i.e., truncated trigonal pyramids) and are arranged on the working surface according to a predetermined pattern 119 and orientation. Transferred abrasive particles 126 may be adhered to front surface 132 (e.g., after contacting the abrasive particles with the scrim, but before separating the first reinforcing member and the positioning tool) either by tackiness of the liquid binder precursor on the reinforcing member or by heating the particulate binder precursor and/or adhesive binder precursor sufficiently that it: a) preferably flows; and b) at least partially cures. Filled abrasive preform 120 is completed by depositing space-filling binder precursor 140 onto front surface 132 of first reinforcing member 130 and transferred abrasive particles 126 such that space between abrasive particles 126 is at least partially filled with optional space-filling binder precursor 140.

Abrasive article precursor 160 is provided by disposing optional second reinforcing member 142 onto space-filling binder precursor 140 and transferred abrasive particles 126.

Abrasive preforms and articles according to the present disclosure may include ceramic and/or non-ceramic abrasive particles. In some embodiments, the abrasive particles comprise precisely-shaped abrasive particles (e.g., comprising an oxide or carbide of at least one metal). Examples of ceramic metal oxides include aluminum oxide, magnesium aluminum oxides (e.g., spinel), zirconia, sodium aluminum oxides, strontium aluminum oxides, lithium aluminum oxides, iron aluminum oxides, magnesium aluminum oxides, and/or manganese aluminum oxides. Examples of suitable ceramic metal carbides include silicon carbide, titanium carbide, and tungsten carbide.

Abrasive particles composed of crystallites of alpha alumina, magnesium alumina spinel, and a rare earth hexagonal aluminate may be prepared according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Examples of sol-gel-derived abrasive particles and methods for their preparation can be found in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.) and in U.S. Publ. Pat. Appln. No. 2009/0165394 A1 (Culler et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the abrasive particles to the binder. The abrasive particles may be treated before combining them with the binder, or they may be surface treated in situ by including a coupling agent to the binder.

Although there is no particular limitation on the shape of the shaped abrasive particles, they are preferably formed into a predetermined shape by shaping precursor particles comprising a ceramic precursor material (e.g., a boehmite sol-gel) using a mold, followed by sintering. The shaped abrasive particles may include a single kind of abrasive particles or an abrasive aggregate formed by two or more kinds of abrasive or an abrasive mixture of two or more kind of abrasives. In some embodiments, the shaped abrasive particles are precisely-shaped in that individual shaped abrasive particles will have a shape that is essentially the shape of the portion of the cavity of a mold or positioning tool in which the particle precursor was dried, prior to optional calcining and sintering.

In some embodiments, the abrasive particles comprise shaped abrasive particles (e.g., shaped sol-gel-derived polycrystalline alpha alumina particles) that are generally shaped as prisms (e.g., 3-, 4-, 5-, or 6-sided prisms) or truncated pyramids (e.g., 3-, 4-, 5-, or 6-sided truncated pyramids). In some embodiments, sol-gel-derived shaped alpha alumina particles are precisely-shaped (i.e., the particles have shapes that are at least partially determined by the shapes of cavities in a positioning tool used to make them. Examples of sol-gel-derived shaped alpha alumina abrasive particles can be found in U.S. Pat. No. 5,201,916 (Berg); U.S. Pat. No. 5,366,523 (Rowenhorst (Re 35,570)); and U.S. Pat. No. 5,984,988 (Berg).

Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Shaped abrasive particles used in the present disclosure can typically be made using tools (i.e., molds) cut using precision machining, which provides higher feature definition than other fabrication alternatives such as, for example, stamping or punching. Typically, the cavities in the tool surface have planar faces that meet along sharp edges, and form the sides and top of a truncated pyramid. The resultant shaped abrasive particles have a respective nominal average shape that corresponds to the shape of cavities (e.g., truncated pyramid) in the tool surface; however, variations (e.g., random variations) from the nominal average shape may occur during manufacture, and shaped abrasive particles exhibiting such variations are included within the definition of shaped abrasive particles as used herein.

In some embodiments, the base and the top surfaces of the shaped abrasive particles are substantially parallel, resulting in prismatic or truncated pyramidal shapes, although this is not a requirement. In some embodiments, the sides of a truncated trigonal pyramid have equal dimensions and form dihedral angles with the base of about 82 degrees. However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

As used herein in referring to shaped abrasive particles, the term "length" refers to the maximum dimension of a shaped abrasive particle. "Width" refers to the maximum dimension of the shaped abrasive particle that is perpendicular to the length. The terms "thickness" or "height" refer to the dimension of the shaped abrasive particle that is perpendicular to the length and width.

Abrasive particles are typically selected to have a length in a range of from 1 micron to 15000 microns, more typically 10 microns to about 10000 microns, and still more typically from 150 to 2600 microns, although other lengths may also be used.

Preferably, shaped abrasive particles have a width in a range of from 0.1 micron to 3500 microns, more preferably 100 microns to 3000 microns, and more preferably 100 microns to 2600 microns, although other widths may also be used. Preferably, shaped abrasive particles have a thickness in a range of from 0.1 micron to 1600 microns, more preferably from 1 micron to 1200 microns, although other thicknesses may be used. In some embodiments, shaped abrasive particles may have an aspect ratio (length to thickness) of at least 2, 3, 4, 5, 6, or more.

In some embodiments, the length may be expressed as a fraction of the thickness of the abrasive wheel in which it is contained. For example, the shaped abrasive particle may have a length greater than half the thickness of the abrasive wheel. In some embodiments such as, for example, cut-off wheels, the length of the shaped abrasive particles may be may be greater than the thickness of the cut-off wheel.

Abrasive preforms and articles according to the present disclosure may optionally contain additional abrasive particles in addition to the shaped abrasive particles.

Useful additional abrasive particles may comprise, for example, any of the shaped abrasive particles disclosed hereinabove, and/or especially crushed grain abrasive particles. The additional abrasive particles may be may be crushed or shaped, or a combination thereof. The additional abrasive particles may be included in the space-filling binder precursor.

Useful additional abrasive particles (e.g., crushed abrasive particles) may comprise, for example: fused aluminum oxide; heat-treated aluminum oxide; white fused aluminum oxide; ceramic aluminum oxide materials such as those commercially available under the trade designation 3M CERAMIC ABRASIVE GRAIN from 3M Company, Saint Paul, Minn.; brown aluminum oxide; blue aluminum oxide; and sol-gel-derived abrasive particles (e.g., including shaped and crushed forms); and combinations thereof.

Surface coatings on the abrasive particles (e.g., shaped abrasive particles and/or crushed abrasive particles) may be used to improve the adhesion between the abrasive particles and the binder material, or can be used to aid in deposition of the ceramic abrasive particles. In one embodiment, surface coatings as described in U.S. Pat. No. 5,352,254 (Celikkaya) in an amount of 0.1 to 2 percent surface coating to shaped abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the shaped abrasive particles. Surface coatings to perform the above functions are known to those of skill in the art.

Abrasive particles (e.g., crushed or shaped abrasive particles) may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). Such industry accepted grading standards include, for example: ANSI 4, ANSI 6, ANSI 8, ANSI 16, ANSI 24, ANSI 30, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600; FEPA P8, FEPA P12, FEPA P16, FEPA P24, FEPA P30, FEPA P36, FEPA P40, FEPA P50, FEPA P60, FEPA P80, FEPA P100, FEPA P120, FEPA P150, FEPA P180, FEPA P220, FEPA P320, FEPA P400, FEPA P500, FEPA P600, FEPA P800, FEPA P1000, FEPA P1200; FEPA F8, FEPA F12, FEPA F16, and FEPA F24; and JIS 8, JIS 12, JIS 16, HS 24, JIS 36, JIS 46, JIS 54, JIS 60, JIS 80, JIS 100, JIS 150, JIS 180, JIS 220, JIS 240, JIS 280, JIS 320, JIS 360, JIS 400, JIS 400, JIS 600, JIS 800, JIS 1000, JIS 1500, JIS 2500, JIS 4000, JIS 6000, JIS 8000, and JIS 10,000. More typically, the crushed aluminum oxide particles and the non-seeded sol-gel derived alumina-based abrasive particles are independently sized to ANSI 60 and 80, or FEPA F36, F46, F54 and F60 or FEPA P60 and P80 grading standards.

Alternatively, abrasive particles (e.g., shaped or crushed abrasive particles) can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the ceramic shaped abrasive particles pass through a test sieve meeting ASTM E-11 specifications for the number 18 sieve and are retained on a test sieve meeting ASTM E-11 specifications for the number 20 sieve. In one embodiment, the abrasive particles have a particle size such that most of the particles pass through an 18 mesh test sieve and can be retained on a 20, 25, 30, 35, 40, 45, or 50 mesh test sieve. In various embodiments, the ceramic shaped abrasive particles can have a nominal screened grade comprising: −18+20, −20+25, −25+30, −30+35, −35+40, −40+45, −45+50, −50+60, −60+70, −70+80, −80+100, −100+120, −120+140, −140+170, −170+200, −200+230, −230+270, −270+325, −325+400, −400+450, −450+500, or −500+635. Alternatively, a custom mesh size could be used such as −90+100.

Suitable curable materials for the particulate binder precursor, liquid binder precursor, and space-filling binder precursor include, for example, one or more organic thermosetting compounds, typically containing one or more additive(s) such as, for example, fillers, curatives (e.g., catalysts, hardeners, free-radical initiators (photo- or thermal), grinding aids (e.g., cryolite), plasticizers, antiloading compounds, lubricants, coupling agents, antioxidants, light stabilizers, and/or antistatic agents.

Examples of suitable organic thermosetting compounds include phenolic resins (e.g., novolac and/or resole phenolic resins), acrylic monomers (e.g., poly(meth)acrylates, (meth) acrylic acid, (meth)acrylamides), epoxy resins, cyanate resins, isocyanate resins (include polyurea and polyurethane resins), alkyd resins, urea-formaldehyde resins, aminoplast resins, and combinations thereof. During curing, these thermosetting compounds develop a covalently crosslinked bond network that hardens and strengthens the resulting binder material.

Useful phenolic resins include novolac and resole phenolic resins. Novolac phenolic resins are characterized by being acid-catalyzed and having a ratio of formaldehyde to phenol of less than one, typically between 0.5:1 and 0.8:1. Resole phenolic resins are characterized by being alkaline catalyzed and having a ratio of formaldehyde to phenol of greater than or equal to one, typically from 1:1 to 3:1. Novolac and resole phenolic resins may be chemically modified (e.g., by reaction with epoxy compounds), or they may be unmodified. Exemplary acidic catalysts suitable for curing phenolic resins include sulfuric, hydrochloric, phosphoric, oxalic, and p-toluenesulfonic acids Alkaline catalysts suitable for curing phenolic resins include sodium hydroxide, barium hydroxide, potassium hydroxide, calcium hydroxide, organic amines, and/or sodium carbonate.

Novolac phenolic resins are typically solid at ambient temperatures and are generally available in powder and/or granular form. They are particularly well suited for use as the particulate binder precursor and the space-filling binder precursor; however, other solid thermosetting resins may be used instead or in addition.

Resole phenolic resins are typically liquid at ambient. They are particularly well suited for use as the liquid binder precursor, although other liquid thermosetting resins are also typically suitable.

Examples of commercially available phenolic resins include those known by the trade designations "DUREZ" and "VARCUM" from Durez Corporation, Novi, Mich.; "RESINOX" from Monsanto Corp., Saint Louis, Mo.; "AROFENE" and "AROTAP" from Ashland Chemical Co., Columbus, Ohio; "RUTAPHEN" by Momentive, Columbus, Ohio; and "PHENOLITE" by Kangnam Chemical Company Ltd., Seoul, South Korea. Examples of commercially available novolac resins include those marketed as DUREZ 1364 and VARCUM 29302 from Durez Corporation. Examples of commercially available resole phenolic resins include VARCUM resoles in grades 29217, 29306, 29318, 29338, and 29353; AEROFENE 295; and PHENOLITE TD-2207.

Examples of useful aminoplasts include those available as CYMEL 373 and CYMEL 323 from Cytec Inc., Stamford, Conn.

Examples of useful urea-formaldehyde resins include that marketed as AL3029R from Borden Chemical, Columbus, Ohio, and those marketed as AMRES LOPR, AMRES PR247HV and AMRES PR335CU by Georgia Pacific Corp., Atlanta, Ga.

Examples of useful polyisocyanates include monomeric, oligomeric, and polymeric polyisocyanates (e.g., diisocyanates and triisocyanates), and mixtures and blocked versions thereof. Polyisocyanates may be aliphatic, aromatic, and/or a mixture thereof.

Examples of useful polyepoxides include monomeric polyepoxides, oligomeric polyepoxides, polymeric polyepoxides, and mixtures thereof. The polyepoxides may be aliphatic, aromatic, or a mixture thereof.

Examples of alicyclic polyepoxides monomers include epoxycyclohexane-carboxylates (e.g., 3,4-epoxycyclohexylmethyl 3,4-epoxycyclohexanecarboxylate (e.g., as available under the trade designation "ERL-4221" from Dow Chemical Co., Midland, Mich.); 3,4-epoxy-2-methylcyclohexylmethyl 3,4-epoxy-2-methylcyclohexane-carboxylate; bis(3,4-epoxy-6-methylcyclohexylmethyl) adipate; 3,4-epoxy-6-methylcyclohexylmethyl 3,4-epoxy-6-methylcyclohexanecarboxylate (available as ERL-4201 from Dow Chemical Co.); vinylcyclohexene dioxide (available as ERL-4206 from Dow Chemical Co.); bis(2,3-epoxycyclopentyl)ether (available as ERL-0400 from Dow Chemical Co.); bis(3,4-epoxy-6-methylcyclohexylmethyl) adipate (available as ERL-4289 from Dow Chemical Co.); dipenteric dioxide (available as ERL-4269 from Dow Chemical Co.); 2-(3,4-epoxycyclohexyl)-5,1'-spiro-3',4'-epoxycyclohexane-1,3-dioxane; and 2,2-bis(3,4-epoxycyclohexyl)propane; and polyepoxide resins derived from epichlorohydrin).

Examples of aromatic polyepoxides include polyglycidyl ethers of polyhydric phenols such as: Bisphenol A-type resins and their derivatives, including such epoxy resins having the trade designation "EPON" available from Resolution Performance Products, Houston, Tex.; epoxy cresol-novolac resins; Bisphenol-F resins and their derivatives; epoxy phenol-novolac resins; and glycidyl esters of aromatic carboxylic acids (e.g., phthalic acid diglycidyl ester, isophthalic acid diglycidyl ester, trimellitic acid triglycidyl ester, and pyromellitic acid tetraglycidyl ester), and mixtures thereof. Commercially available aromatic polyepoxides include, for example, those having the trade designation "ARALDITE" available from Ciba Specialty Chemicals, Tarrytown, N.Y.; aromatic polyepoxides having the trade designation "EPON" available from Resolution Performance Products; and aromatic polyepoxides having the trade designations "DER", "DEN", and "QUATREX" available from Dow Chemical Co.

Polyepoxide(s) are typically combined with a curing agent such as for example, a polyamine (e.g., a bis(imidazole)), polyamide (e.g., dicyandiamide), polythiol, or an acidic catalyst, although the curing agent may not be required for curing.

Useful acrylic resins may include at least one (meth) acrylate (the term "(meth)acrylate" refers to acrylate and/or methacrylate) monomer or oligomer having an average acrylate functionality of at least two, for example, at least 3, 4, or even 5, and may be a blend of different (meth)acrylate monomers, (meth)acrylate oligomers, and/or (meth)acrylated polymers. A wide variety of (meth)acrylate monomers, (meth)acrylate oligomers, and (meth)acrylated polymers are readily commercially available, for example, from such vendors as Sartomer Company, Exton, Pa., and UCB Radcure, Smyrna, Ga. Exemplary acrylate monomers include ethylene glycol di(meth)acrylate, hexanediol di(meth)acrylate, triethylene glycol di(meth)acrylate, trimethylolpropane tri(meth)acrylate, glycerol tri(meth)acrylate, pentaerythritol tri(meth)acrylate, ethoxylated trimethylolpropane tri(meth) acrylate, neopentyl glycol di(meth)acrylate, pentaerythritol tetra(meth)acrylate, dipentaerythritol penta(meth)acrylate, sorbitol tri(meth)acrylate, sorbitol hexa(meth)acrylate, Bisphenol A di(meth)acrylate, ethoxylated Bisphenol A di(meth)acrylates, and mixtures thereof. Additional useful polyfunctional (meth)acrylate oligomers include polyether oligomers such as a polyethylene glycol 200 diacrylate marketed by Sartomer Company as SR 259; and polyethylene glycol 400 diacrylate marketed by Sartomer Company as SR 344.

Polymerizable acrylic monomers and oligomers such as those above, are typically cured with the aid of at least one free-radical thermal initiator (e.g., organic peroxides) or photoinitiator (e.g., thioxanthones, acylphosphines, acylphosphine oxides, benzoin ketals, alpha-hydroxy ketones, and alpha-dialkylamino ketones). Typical amounts range from 0.1 to 10 percent by weight, preferably 1 to 3 percent by weight, based on the weight of the organic binder material precursor.

Organic thermosetting compound(s) and optional thermoplastic polymer (if present) are typically used in an amount sufficient to result in a total organic binder material content of from about 5 to about 30 percent, more typically about 10 to about 25 percent, and more typically about 15 to about 24 percent by weight, based on the total weight of the resultant abrasive article, although other amounts may also be used.

In a preferred embodiment, the binder material precursor comprises a novolac-type phenolic resin in combination with furfuryl alcohol and filler. In a preferred embodiment, the malleable thermosetting binder material precursor composition comprises a novolac phenolic resin (in powder form) in combination with furfuryl alcohol, and filler. Preferred compositions comprise, on a total weight basis, from 3 to 12 percent of furfuryl alcohol (more preferably 4 to 8 percent), from 30 to 60 percent of novolac phenolic resin (optionally containing hexamethylenetetramine), more preferably 35 to 45 percent), and from 40 to 70 percent of grinding aids and/or/fillers. Novolac resins are typically solids at room temperature, but by addition of furfuryl alcohol and filler (and any additional components) they are preferably formulated to form a malleable and/or putty-like composition that is moldable, but will retain its shape unless heated and/or subjected to mechanical force (e.g., stretched or squished). Examples of commercially available novolac phenolic resins include those available as: GP 2074, GP 5300, GP 5833, RESI-FLAKE GP-2049, RESI-FLAKE GP-2050, and RESI-FLAKE GP-2211 from Georgia Pacific Resins, Atlanta, Ga.; RUTAPHEN 8656F from Bakelite AG, Frielendorf, Germany; and DURITE 423 A and DURITE SD 1731 from Borden Chemical, Inc., Columbus, Ohio.

Examples of useful fillers include metal carbonates (e.g., calcium carbonate (e.g., chalk, calcite, marl, travertine, marble and limestone, calcium magnesium carbonate, sodium carbonate, magnesium carbonate)), potassium aluminum fluoride, silica (e.g., quartz, glass beads, glass bubbles and glass fibers), silicates (e.g., talc, clays, (montmorillonite) feldspar, mica, calcium silicate, calcium metasilicate, sodium aluminosilicate, sodium silicate), metal sulfates (e.g., calcium sulfate, barium sulfate, sodium sulfate, aluminum sodium sulfate, aluminum sulfate), silicon carbide, gypsum, vermiculite, wood flour, aluminum trihydrate, carbon black, metal oxides (e.g., calcium oxide (lime), aluminum oxide, titanium dioxide), and metal sulfites (e.g., calcium sulfite).

For particulate binder precursors and fillers, the size of the particles is not particularly important as long as they are small enough to be suitable for their intended use. Typically, powdered forms are preferred as they can fit into small features.

As used herein, the term "particulate binder precursor" means that the binder precursor comprises solid or semi-solid particle. Liquid binder precursor droplets/mists are excluded by the term "particulate binder precursor".

In order to facilitate contact adhesion to the abrasive particles or frame(s), a liquid binder precursor may be applied to the abrasive particles or frame(s) such that the particulate binder precursor and/or space-filling binder precursor (if particulate) will adhere (e.g., by capillary action) until cured in placed.

Referring again to FIG. 1, optional second reinforcing member 142 is disposed on abrasive preform 120 such that front surface 132 of first reinforcing member 130 faces second reinforcing member 142 to provide an abrasive article precursor 160.

Examples of suitable reinforcing members (first and/or second reinforcing members) include backings and reinforcing scrims known for use in coated abrasive articles, bonded abrasive articles, and unitized abrasive wheels. Examples include paper, polymeric film, metal foil, vulcanized fiber, synthetic fiber and/or natural fiber nonwovens (e.g., lofty open nonwoven synthetic fiber webs and meltspun scrims), synthetic and/or natural fiber knits, synthetic fiber and/or natural fiber wovens (e.g., woven glass fabrics/scrims, woven polyester fabrics, treated versions thereof, and combinations thereof). Examples of suitable porous reinforcing scrims include porous fiberglass scrims and porous polymeric scrims (e.g., comprising polyolefin, polyamide, polyester, cellulose acetate, polyimide, and/or polyurethane) which may be melt-spun, melt blown, wet-laid, or air-laid, for example.

The selection of porosity and basis weight of the various reinforcing members (e.g., scrims and backings) described herein are within the capability of those skilled in the abrasives art, and typically depend on the intended use.

Referring again to FIG. 1, the abrasive article precursor 160 is cured under compression (wherein abrasive preform 120 and second reinforcing member 142 are compressed together) to provide abrasive article 180 (e.g., a cut-off wheel).

Selection of curing conditions will vary depending on the particular abrasive article being made, and the binder precursor system(s) chosen. Such selection is within the capabilities of one of ordinary skill in the art.

Heating generally occurs with applied external pressure (e.g., in a heated press or mold), although this is not a requirement. Heating conditions will depend on the nature of the specific binder material precursor selected and the intended abrasive article.

For example, bonded abrasives with organic resinous binders are typically heated at temperatures up to about 220° C. (although higher temperatures may also be used) for sufficient time to cure the thermosetting material and form a durable binder material.

Figure 3:
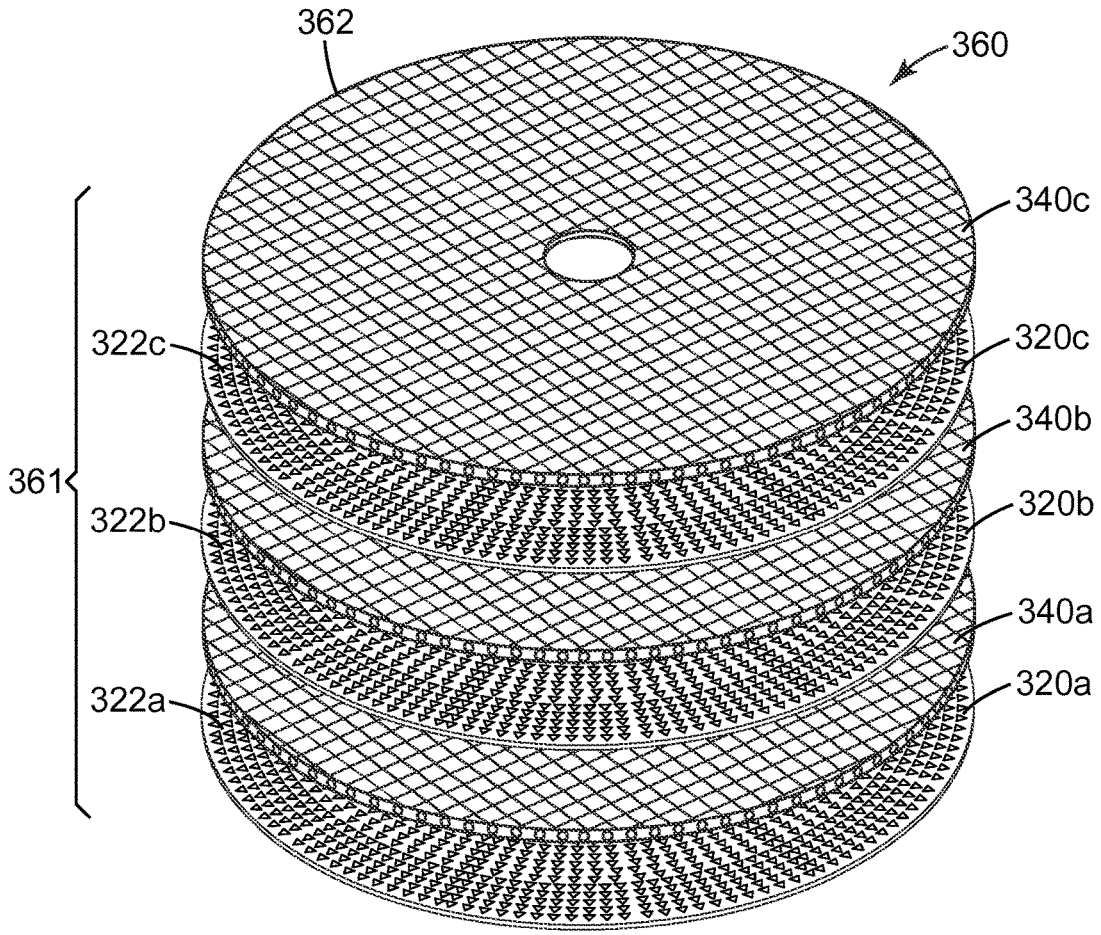
FIG. 3 is a schematic exploded perspective view of abrasive article precursor 360.

In another embodiment (shown in FIG. 3), filled abrasive preforms 320*a*, 320*b*, 320*c* (prepared as abrasive preform 120 shown in FIG. 1) are stacked to form an abrasive article precursor 360. Filled abrasive preforms 320*a*, 320*b*, 320*c* have respective front sides 322*a*, 322*b*, 322*c*.

Stack 361 comprises filled abrasive preforms 320*a*, 320*b*, 320*c* and optional reinforcing members 340*a*, 340*b*, 340*c* adjacent to front sides 322*a*, 322*b*, 322*c*. Front sides 322*a*, 322*b*, 322*c* of filled abrasive preforms 320*a*, 320*b*, 320*c* face top 362 of stack 361.

Abrasive article precursor 360 is cured under compression such that filled abrasive preforms 320*a*, 320*b*, 320*c* and reinforcing members 342 are compressed together and heated to form an abrasive article.

Figure 4A:
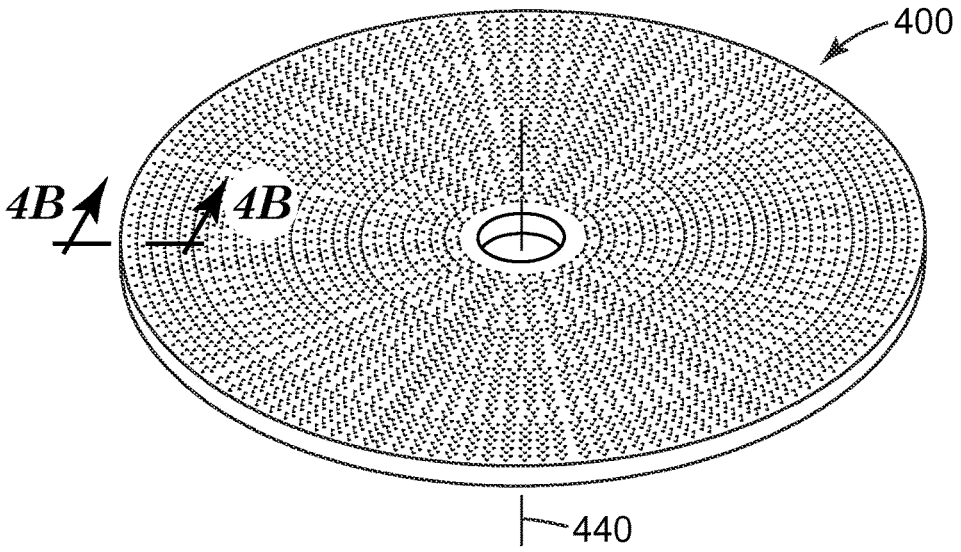
FIG. 4A is a schematic perspective view of exemplary bonded abrasive wheel 400.
Figure 4B:
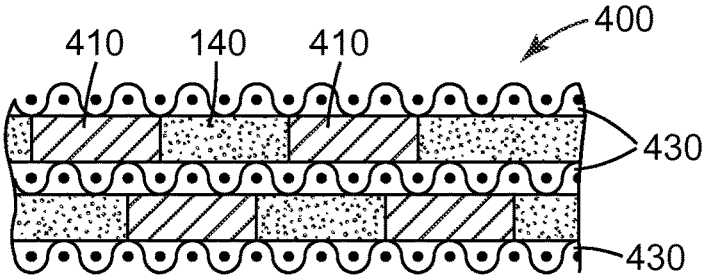
FIG. 4B is a schematic of a precisely-shaped abrasive particle 410 and a space-filling binder precursor 140 within bonded abrasive wheel 400.

Methods according to the present disclosure are useful for preparing abrasive articles such as, for example, cutoff wheels and grinding wheels. Referring now to FIGS. 4A and 4B, exemplary bonded abrasive wheel 400 comprises precisely-shaped abrasive particles 410 retained in an organic binder material 140, reinforced by optional scrims 430. Precisely-shaped abrasive particles 410 are aligned perpendicular to rotational axis 440 of bonded abrasive wheel 400 according to a predetermined three-dimensional position and orientation.

Figure 5:
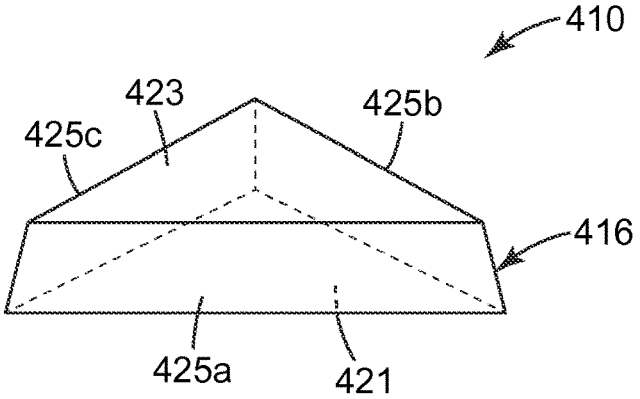
FIG. 5 is a schematic perspective view of precisely-shaped abrasive particle 410.

Referring now to FIG. 5, precisely-shaped abrasive particles 410 comprise truncated trigonal pyramids comprising base 421 and top 423 connected by three sloping sidewalls 425*a*, 425*b*, 425*c* forming peripheral surface 416. Base 421 and top 423 contact and are separated by peripheral surface 416.

Abrasive articles according to the present disclosure are useful, for example, as hones, grinding wheels, and cut-off wheels.

Grinding wheels typically have a thickness of 0.5 cm to 100 cm, more typically 1 cm to 10 cm, and typically have a diameter between about 1 cm and 100 cm, more typically between about 10 cm and 100 cm, although other dimensions may also be used. For example, abrasive articles may be in the form of a cup wheel generally between 10 and 15 cm in diameter, or may be in the form of a snagging wheel of up to 100 cm in diameter. An optional center hole may be used to attach the grinding wheel to a power-driven tool. If present, the center hole is typically 0.5 cm to 2.5 cm in diameter, although other sizes may be used. The optional center hole may be reinforced; for example, by a metal flange. Alternatively, a mechanical fastener may be axially secured to one surface of the cut-off wheel. Examples include threaded posts and bayonet mounts.

Typical cut-off wheels typically have a thickness of 0.80 millimeter (mm) to 16 mm, more typically 1 mm to 8 mm, and typically have a diameter between 2.5 cm and 100 cm (40 inches), more typically between about 7 cm and 13 cm, although diameters of up to several meters are known. An optional center hole (which may be depressed) may be used to attaching the cut-off wheel to a power driven tool. If present, the center hole is typically 0.5 cm to 2.5 cm in diameter, although other sizes may be used. The optional center hole may be reinforced; for example, by a metal flange. Alternatively, a mechanical fastener may be axially secured to one surface of the cut-off wheel. Examples include threaded posts, threaded nuts, Tinnerman nuts, and bayonet mount posts.

Abrasive articles prepared according to the present disclosure are useful, for example, for abrading a workpiece. For example, they may be formed into grinding or cut-off wheels that exhibit good grinding characteristics while maintaining a relatively low operating temperature that may avoid thermal damage to the workpiece.

In use, the method typically comprises: frictionally contacting abrasive particles in the abrasive article with a surface of the workpiece, and moving at least one of the abrasive article and the surface of the workpiece relative to the other to abrade at least a portion of the surface of the workpiece. The abrasive articles may also be used in precision abrading applications such as grinding cam shafts with vitrified bonded wheels. The size of the abrasive particles used for a particular abrading application will be apparent to those skilled in the art.

Bonded abrasive wheels may be used mounted on a grinding tool (e.g., a right angle grinding tool). The tool can be electrically or pneumatically driven, generally at speeds from about 1000 to 50000 revolutions per minute (rpm).

Abrading may be carried out dry or wet. For wet abrading, the liquid may be introduced supplied in the form of a light mist to complete flood. Examples of commonly used liquids include: water, water-soluble oil, organic lubricant, and emulsions. The liquid may serve to reduce the heat associated with abrading and/or act as a lubricant. The liquid may contain minor amounts of additives such as bactericide, antifoaming agents, and the like.

Examples of workpieces include aluminum metal, carbon steels, mild steels (e.g., 1018 mild steel and 1045 mild steel), tool steels, stainless steel, hardened steel, titanium, glass, ceramics, wood, wood-like materials (e.g., plywood and particle board), paint, painted surfaces, organic coated surfaces and the like. The applied force during abrading typically ranges from about 1 to about 100 kilograms (kg), although other pressures can also be used.

Select Embodiments of the Present Disclosure

In a first embodiment, the present disclosure provides a method of making an abrasive article, the method comprising steps:

a) providing a positioning tool having a working surface with cavities formed therein, wherein the cavities are arranged on the working surface according to a pattern and orientation;

b) making an abrasive preform comprising shaped abrasive particles adhered to a first reinforcing member having opposed front and back surfaces, and wherein the abrasive preform is made by a method comprising:

i) disposing the shaped abrasive particles in at least some of the cavities of the positioning tool;

ii) transferring the shaped abrasive particles to the first reinforcing member that shaped abrasive particles are disposed proximate to the front surface of the first reinforcing member according to the pattern of the cavities;

iii) adhering the transferred shaped abrasive particles to the front surface of the first reinforcing member; and iv) depositing a space-filling binder precursor on the first reinforcing member and transferred shaped abrasive particles such that space between the shaped abrasive particles is at least partially filled with the space-filling binder precursor;

c) disposing a second reinforcing member on the abrasive preform wherein the front surface of the first reinforcing member faces said second reinforcing member to provide an abrasive article precursor; and d) compressing and curing the abrasive article precursor to form the abrasive article.

In a second embodiment, the present disclosure provides a method according to the first embodiment, wherein in step i) the shaped abrasive particles have a particulate binder precursor disposed on at least a portion of their surfaces.

In a third embodiment, the present disclosure provides a method according to the second embodiment, wherein the particulate binder precursor is disposed on the shaped abrasive particles by a method comprising:

depositing a thin coating of a liquid binder precursor on the surface of the shaped abrasive particles; and then adhering the particulate binder precursor to the thin coating of a liquid binder precursor.

In a fourth embodiment, the present disclosure provides a method according to the third embodiment, wherein the liquid binder precursor comprises a resole phenolic resin.

In a fifth embodiment, the present disclosure provides a method according to any one of the first to fourth embodiments, wherein in step i) the front surface of the reinforcing member abrasive particles has a curable adhesive precursor disposed on at least a portion thereof.

In a sixth embodiment, the present disclosure provides a method according to any one of the first to fifth embodiments, wherein the predetermined pattern and orientation of the cavities has a rotational axis of symmetry, and wherein the cavities are arranged in radially overlapping circumferential rows.

In a seventh embodiment, the present disclosure provides a method according to any one of the first to sixth embodiments, wherein the shaped abrasive particles comprise precisely-shaped abrasive particles, wherein the precisely-shaped abrasive particles comprise a base and a top connected by a plurality of sidewalls, and wherein the respective bases of the precisely-shaped abrasive particles are aligned substantially parallel to the back of the abrasive preform.

In an eighth embodiment, the present disclosure provides a method according to any one of the first to seventh embodiments, wherein a majority of the cavities have planar bottoms parallel to the working surface of the positioning tool.

In a ninth embodiment, the present disclosure provides a method according to any one of the first to eighth embodiments, wherein at least some of the cavities comprise conduits that extend away from the working surface of the positioning tool toward a source of reduced pressure.

In a tenth embodiment, the present disclosure provides a method according to any one of the first to ninth embodiments, wherein at least one of the particulate binder precursor and the space-filling binder precursor comprises a novolac phenolic resin.

In an eleventh embodiment, the present disclosure provides a method according to any one of the first to tenth embodiments, wherein the first reinforcing member comprises a porous scrim.

In a twelfth embodiment, the present disclosure provides a method of making an abrasive article, the method comprising steps:

a) providing a positioning tool having a working surface with cavities formed therein, wherein the cavities are arranged on the working surface according to a pattern;

b) making a plurality of abrasive preforms, wherein each abrasive preform respectively comprises shaped abrasive particles adhered to a first reinforcing member, and wherein each abrasive preform is respectively made by a method comprising:

i) disposing shaped abrasive particles in at least some of the cavities of the positioning tool;

ii) transferring the shaped abrasive particles to a first reinforcing member having front and back surfaces such that shaped abrasive particles are disposed on the front surface of the first reinforcing member according to the pattern of the cavities;

iii) adhering the transferred shaped abrasive particles to the front surface of the first reinforcing member;

iv) depositing a space-filling binder precursor onto the first reinforcing member and transferred shaped abrasive particles such that space between shaped abrasive particles is at least partially filled with the space-filling binder precursor;

d) forming a stack comprising the plurality of abrasive preforms, wherein the stack has a top and a bottom, thereby providing an abrasive article precursor; and e) curing the abrasive article precursor while compressing the plurality of abrasive preforms together to form the abrasive article.

In a thirteenth embodiment, the present disclosure provides a method of making an abrasive article according to the twelfth embodiment, wherein the top and bottom of the stack each comprise a respective first reinforcing member.

In a fourteenth embodiment, the present disclosure provides a method according to the twelfth or thirteenth embodiment, wherein in step i) the shaped abrasive particles have a particulate binder precursor disposed on at least a portion of their surfaces.

In a fifteenth embodiment, the present disclosure provides a method according to the fourteenth embodiment, wherein the particulate binder precursor is disposed on the shaped abrasive particles by a method comprising:

depositing a thin coating of a liquid binder precursor on the surface of the shaped abrasive particles; and then adhering the particulate binder precursor to the thin coating of a liquid binder precursor.

In a sixteenth embodiment, the present disclosure provides a method according to the fifteenth embodiment, wherein the liquid binder precursor comprises a resole phenolic resin.

In a seventeenth embodiment, the present disclosure provides a method according to any one of the twelfth to sixteenth embodiments, wherein in step i) the front surface of the reinforcing member has a curable adhesive precursor disposed on at least a portion thereof.

In an eighteenth embodiment, the present disclosure provides a method according to any one of the twelfth to seventeenth embodiments, wherein the cavities have predetermined shapes, and wherein the cavities are arranged on the working surface according to a predetermined pattern and orientation.

In a nineteenth embodiment, the present disclosure provides a method according to any one of the twelfth to eighteenth embodiments, wherein taken collectively the predetermined three-dimensional position and orientation of the precisely-shaped abrasive particles is rotationally symmetric about the rotational axis, and wherein the precisely-shaped abrasive particles cavities are arranged in radially overlapping circumferential rows.

In a twentieth embodiment, the present disclosure provides a method according to any one of the twelfth to nineteenth embodiments, wherein the shaped abrasive particles comprise precisely-shaped abrasive particles, wherein the precisely-shaped abrasive particles comprise truncated pyramids comprising a base and a top connected by a plurality of sloping sidewalls, and wherein the respective bases of the precisely-shaped abrasive particles are aligned substantially parallel to each other.

In a twenty-first embodiment, the present disclosure provides a method according to any one of the twelfth to twentieth embodiments, wherein a majority of the cavities have planar bottoms parallel to the working surface of the positioning tool.

In a twenty-second embodiment, the present disclosure provides a method according to any one of the twelfth to twenty-first embodiments, wherein at least one of the particulate binder precursor and the space-filling binder precursor comprises a novolac phenolic resin.

In a twenty-third embodiment, the present disclosure provides a method according to any one of the twelfth to twenty-second embodiments, wherein at least some of the shaped abrasive particles comprise precisely-shaped abrasive particles.

In a twenty-fourth embodiment, the present disclosure provides a method according to any one of the twelfth to twenty-third embodiments, wherein the cavities comprise conduits that extend away from the working surface of the positioning tool toward a source of reduced pressure.

In a twenty-fifth embodiment, the present disclosure provides a method according to any one of the twelfth to twenty-fourth embodiments, wherein at least one of the respective reinforcing first members comprises a porous scrim.

In a twenty-sixth embodiment, the present disclosure provides an abrasive wheel comprising precisely-shaped abrasive particles retained in an organic binder material, wherein the abrasive wheel comprises two sides contacting a peripheral surface, wherein the abrasive wheel has a rotational axis extending through its center, wherein at least a portion of the precisely-shaped abrasive particles are disposed in the organic binder material according to a predetermined three-dimensional position and orientation, wherein the precisely-shaped abrasive particles comprise a base and a top connected by a plurality of sidewalls, and wherein the respective bases of the shaped abrasive particles are aligned substantially perpendicular to the rotational axis.

In a twenty-seventh embodiment, the present disclosure provides an abrasive wheel according to the twenty-sixth embodiment, wherein the precisely-shaped abrasive particles comprise truncated pyramids.

In a twenty-eighth embodiment, the present disclosure provides an abrasive wheel according to the twenty-sixth or twenty-seventh embodiment, wherein the organic binder material comprises a cured phenolic resin.

In a twenty-ninth embodiment, the present disclosure provides an abrasive wheel according to any one of the twenty sixth to twenty-eighth embodiment, wherein taken collectively the predetermined three-dimensional position and orientation of the precisely-shaped abrasive particles is rotationally symmetric about the rotational axis.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Preparation of Abrasive Particles

Precisely-shaped alpha alumina abrasive particles SAP1, SAP2, SAP3, SAP4 in the examples were prepared generally according to the disclosure of Example 1 of U.S. Pat. No. 8,142,531 (Adefris et al.) by molding alumina sol-gel in equilateral triangular polypropylene mold cavities, except that the sizes of the abrasive particles were varied, and for SAP1 and SAP3 the impregnating solution consisted of 93.1 weight percent of $Mg(NO_2)_3$, 6.43 weight percent of deionized water, and 0.47 weight percent of $Co(NO_3)_2$.

Table 1, below, lists various materials used in the examples.

TABLE 1

| ABBREVIATION | DESCRIPTION |
|---|---|
| AP1 | 46FRSK brown fused alumina obtained from Treibacher Schleifmittel, Villach, Austria |
| AP2 | 60FRSK brown fused alumina obtained from Treibacher Schleifmittel, Villach, Austria |
| ATH | precipitated alumina trihydrate, about 0.7 micron mean particle size, available as Hydral Coat 7 from Almatis of Pittsburg, Pennsylvania |
| PP | a mixture of 39.4 weight percent novolac resin(obtained as BAKELITE PF 0224 SP from Momentive Specialty Chemicals GmbH, Iserlohn-Letmathe, Germany), 8.2 weight percent of silicon carbide JIS grit size F500 (obtained as SIKA (75-99% silicon carbide), from Saint-Gobain Ceramic Materials AS, Cologne, France), 0.4 weight percent carbon black (obtained as LUVOMAXX LB/S from Lehmann & Voss & Co. KG, Hamburg, Germany), and 52.0 weight percent of PAF (potassium aluminum fluoride from KBM Affilips Master Alloys, Delfzijl, Netherlands) |
| RP | liquid phenolic resin obtained as PREFERE 92 5136G1 from Dynea Erkner GmbH, Erkner, Germany |
| SCA | N-(2-aminoethyl)-4-aminopropyltrimethoxysilane, obtained as DYNASYLAN DAMO-T from Evonik Industries, Essen, Germany |
| SAP1 | alpha alumina abrasive particles shaped as truncated triangular pyramids with equal base side lengths of 1.37 mm, a height of 0.27 mm, and a sidewall inward taper angle of 8 degrees (i.e., the dihedral angle between any sidewall and the base is nominally 82 degrees) |
| SAP2 | alpha alumina abrasive particles shaped as truncated triangular pyramids with equal base side lengths of 0.90 mm, a height of 0.27 mm, and a sidewall inward taper angle of 8 degrees |
| SAP3 | alpha alumina abrasive particles shaped as truncated triangular pyramids with equal base side lengths of 0.67 mm, a height of 0.19 mm, and a sidewall inward taper angle of 8 degrees |
| SAP4 | alpha alumina abrasive particles shaped as truncated triangular pyramids with equal base side lengths of 2.5 mm, a height of 0.55 mm, and a sidewall inward taper angle of 8 degrees |

Cutting Test Method

A 40-inch (16-cm) long sheet of ⅛ inch (3.2 mm) thick stainless steel was secured with its major surface inclined at a 35-degree angle relative to horizontal. A guide rail was secured along the downward-sloping top surface of the inclined sheet. A DeWalt Model D28114 4.5-inch (11.4-cm)/5-inch (12.7-cm) cut-off wheel angle grinder was secured to the guide rail such that the tool was guided in a downward path under the force of gravity.

A cut-off wheel for evaluation was mounted on the tool such that the cut-off wheel encountered the full thickness of the stainless steel sheet when the cut-off wheel tool was released to traverse downward, along the rail under gravitational force. The cut-off wheel tool was activated to rotate the cut-off wheel at 10000 rpm, the tool was released to begin its descent, and the length of the resulting cut in the stainless steel sheet was measured after 60 seconds. Dimensions of the cut-off wheel were measured before and after the cutting test to determine wear.

Example 1

SCA (3.3 grams) was added to 165 grams of RP and mixed by hand with a tongue depressor. The SCA and RP mixture was added to 1950 grams of SAP1 and was mixed in a KitchenAid Commercial mixer (Model KSM C50S). This mixture was then combined with 885 grams of PP in an Eirich mixer (Model# RV02E) bowl and mixed at pan speed of 75 RPM and a rotor motor shaft speed of 977 RPM. The Eirich mixer was used with a counter-clockwise rotation and a 185 mm tool diameter. The resulting mix was then sieved using 16-mesh and 30-mesh screens (+16/−30) to isolate the particulate binder-coated shaped abrasive particles.

Figure 6:
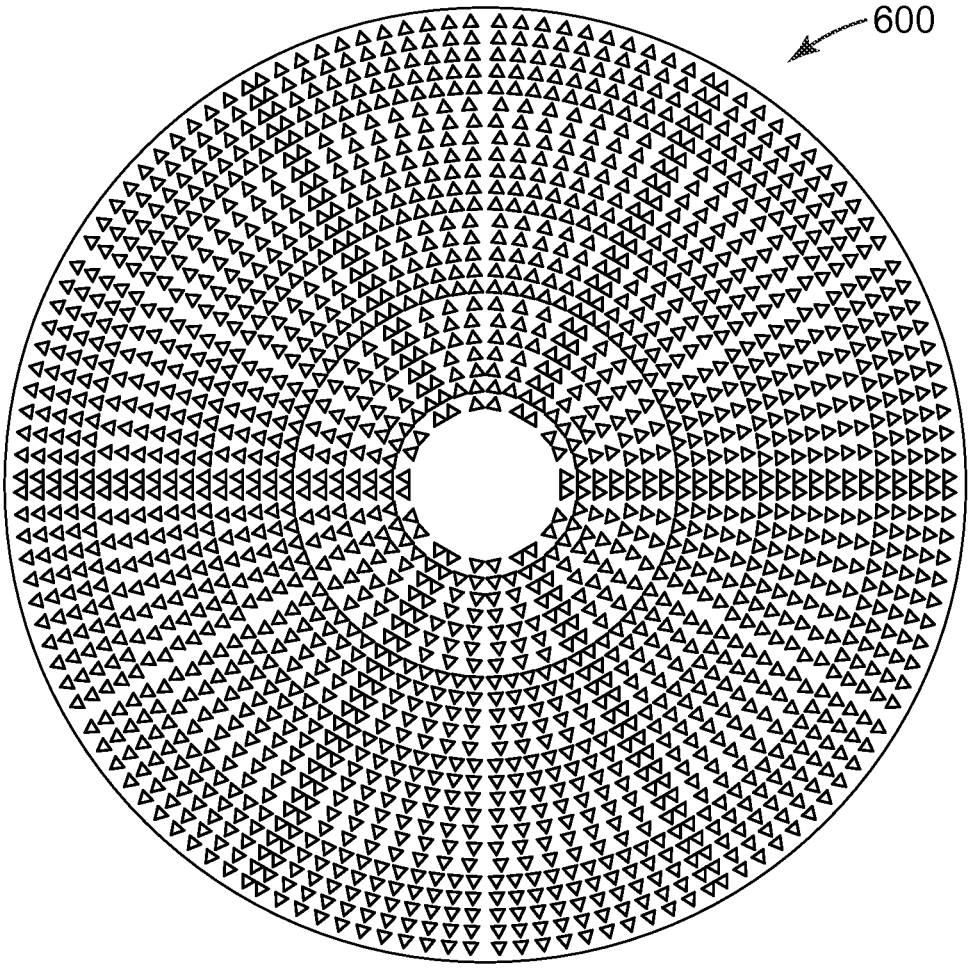
FIG. 6 is a schematic top view of a positioning tool general design used in Example 1.

A positioning tool 600, as shown in FIG. 6, having horizontal triangular-shaped cavities of dimensions 0.075 inch (1.9 mm) long with sidewall angles of 98 degrees relative to the bottom of each cavity, and a mold cavity depth of 0.0138 inch (0.35 mm) arranged in a radial array (all apexes pointing toward the perimeter) was then filled with the particulate binder-coated shaped abrasive particles assisted by tapping. Abrasive particles in excess of those accommodated into the tool's cavities were removed by brushing and shaking.

A 125 mm diameter disc of fiberglass mesh RXO 10-125×23 mm, further referred to as a scrim, from Rymatex in Rymanów, Poland was then coated with a 25 weight percent solution of RP in isopropanol with a paint brush. The coating on the mesh was allowed to air dry for 10 minutes to allow the coating to become tacky. The shaped abrasive particle-containing tool was then brought to close proximity to the adhesive coated disc and inverted to deposit the shaped abrasive particles in a precisely arranged and oriented pattern on the adhesive coated disc. A total of 2.2 grams (g) of resin-coated SAP were applied.

A second 125 mm diameter scrim was identically coated with resin and particles and placed in the bottom of a 5-inch (127-mm) diameter×1-inch (2.5-cm) deep metal mold cavity, coated side up. The mold had an inner diameter of 23-mm. A fill mixture (26.6 g) consisting of 650 grams of AP1, 1.1 grames SCA, 55 grams of RP and 295 grams of PP was then placed on top of the coated scrim. The first scrim was then placed on top of the fill mixture, coated side down. A metal flange 28 mm×22.45 mm×1.2 mm from Lumet PPUH in Jaslo, Poland was placed on top of the first scrim. The mold was closed and the coated scrim-fill-coated scrim sandwich was pressed at a load of 50 tons (907 kg) at room temperature for 2 sec. The cut-off wheel precursor was then removed from the mold and cured in a stack with a 30 hour (hr) cure cycle: 2 hrs at 75° C., 2 hrs at 90° C., 5 hrs at 110° C., 3 hrs at 135° C., 3 hrs at 188° C., 13 hrs at 188° C., and a then 2 hrs cool down to 60° C. The final thickness of the wheel was 0.050 inch. Four replicates of Example 1 were made for a total of 5 wheels.

Example 2

Figure 7:
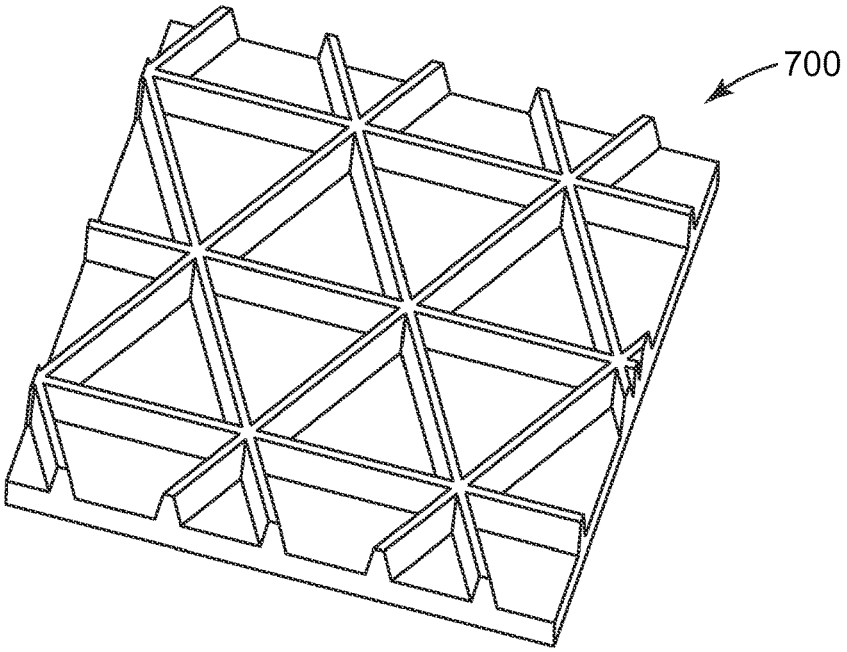
FIG. 7 is a schematic cutaway perspective view of the positioning tool used in Examples 2 and 3.

Example 1 was repeated, except that the positioning tool was a polypropylene sheet having a close-packed array of equilateral triangular cavities as shown in FIG. 7, with triangular-shaped cavities of dimensions 0.088 inch (2.24 mm) side length with a sidewall taper angle of 98 degrees and a mold cavity depth of 0.022 inch (0.559 mm). Each scrim had 5.5 grams of resin-coated SAP2 positioned according to the pattern of the positioning tool, and the fill mixture was about 20 grams of a mixture made with 650 grams of AP1, 55 grams of RP and 295 grams of PP.

Example 3

The abrasive article of Example 3 was prepared identically to Example 2, except that the fill mixture consisted entirely of 20 grams of PP.

Example 4

Figure 9:
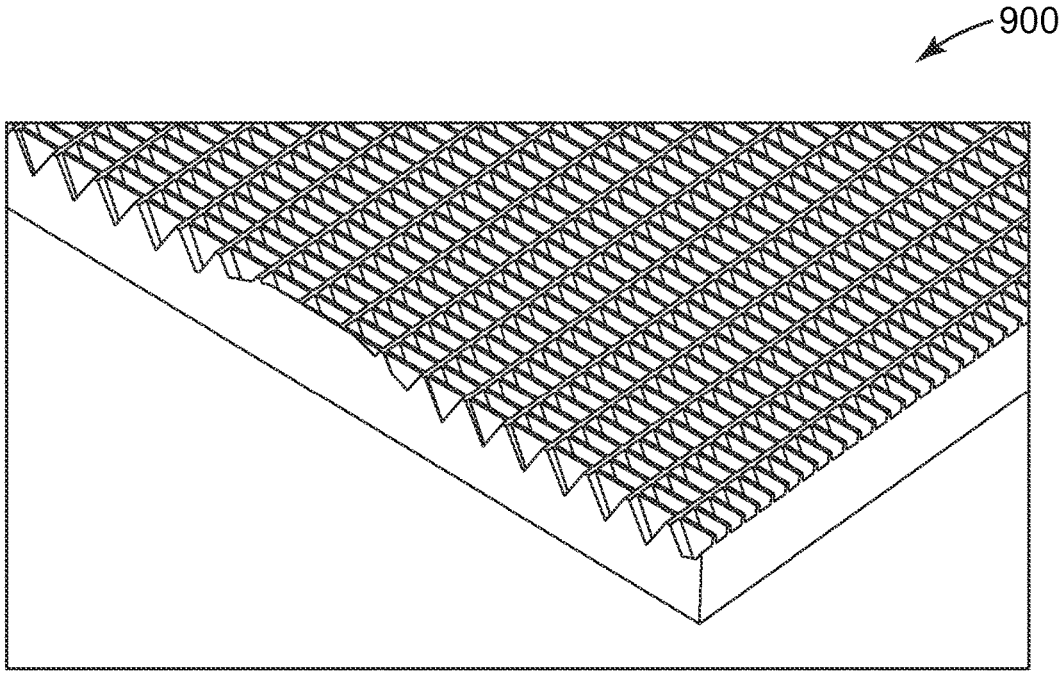
FIG. 9 is a schematic cutaway perspective view of the positioning tool 900 used in Example 4.

Example 1 was repeated, except that the positioning tool had equilateral triangular prism openings with the base of each prism facing the opening in the tooling so that the triangular prism SAP was vertically upside-down in the tooling hole as shown in FIG. 9. The cavities had a 1.698 mm length and a depth of 1.456 mm. The tops of the openings were 0.621 mm wide and the walls slope at an 8 degree angle so that at the deepest point, the cavity width is 0.363 mm. The density of cavities, and thus resin-coated particles positioned on each scrim, was 0.729 cavities/$mm^2$. The area between the grains was filled with PP.

Example 5

Example 1 was repeated, except that the resin-coated particles were made by combining 1.2 grams of SCA with 45 grams of RP and mixed by hand with a tongue depressor. The SCA and RP mixture was added to 650 grams of SAP4 and was mixed in a KitchenAid Commercial mixer (Model KSM C50S). This mixture was then combined with 340 grams of PP in a KitchenAid Commercial mixer (Model KSM C50S). The resulting mix was sieved using 10-mesh and 30-mesh screens (+10/−30) to isolate the abrasive particles.

Figure 8:
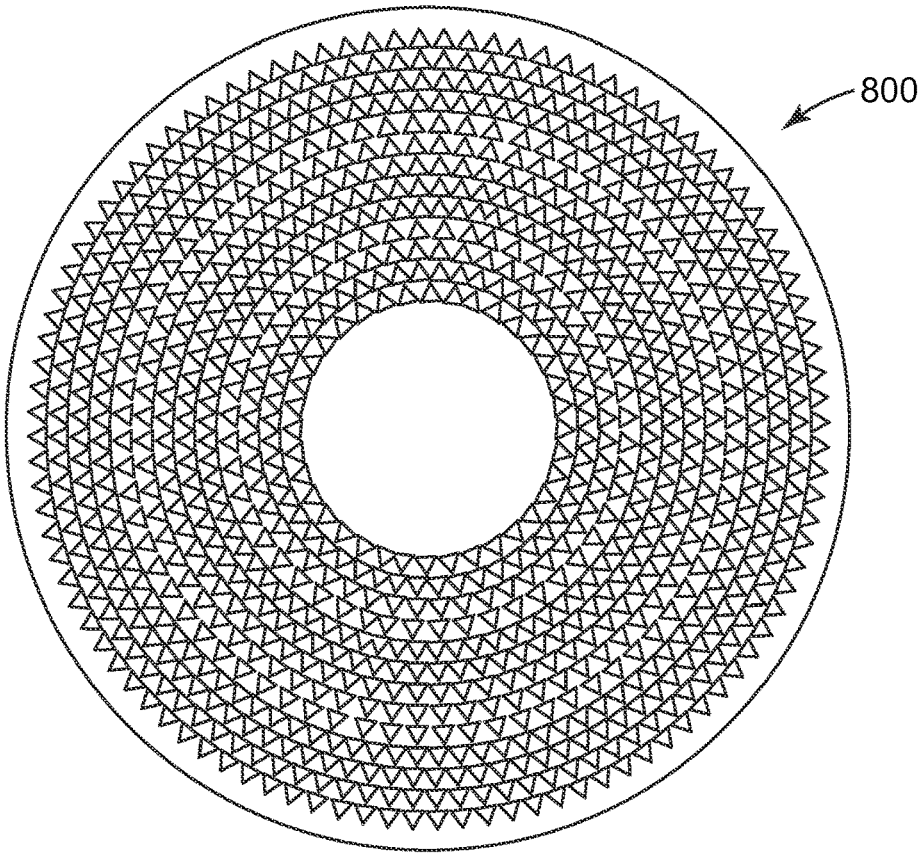
FIG. 8 is a schematic top view of the positioning tool used in Example 5.

The positioning tool 800, as shown in FIG. 8, having horizontal triangular-shaped cavities of dimensions 0.136 inch (3.4545 mm) long with a sidewall angle of 98 degrees and a mold depth of 0.0315 inch (0.8 mm) arranged in a radial array (all apexes pointing toward the perimeter). The positioning tool was then filled with the SAP4 assisted by tapping. Shaped abrasive particles in excess of those accommodated into the tool's cavities were removed by brushing and shaking. The resin-coated abrasive particles (7.2 grams) were transferred to each scrim.

Each resultant abrasive preform was placed in the bottom of a 5-inch (127-mm) diameter×1-inch (2.5-cm) deep metal mold cavity, coated side up. The mold has an inner diameter of 23-mm. A fill mixture (33.8 grams) consisting of 600 grams of AP1, 60 grams of RP, 1.2 grams SPC and 340 grams of PP was then placed on top of the coated scrim. An uncoated scrim was then placed on top of the fill mixture, fiberglass mesh side down followed by a metal flange. The cut-off wheel was molded and cured identically to Example 1. The final thickness of the wheel was 0.073-inch (1.85-mm). Three replicates of Example 5 were made for a total of 4 samples.

Example 6

Example 5 was repeated, except that the SAP4 particles were not resin-coated. The positioning tool was similar to positioning tool 800, as shown in FIG. 8, having horizontal triangular-shaped cavities of dimensions 0.136 inch (3.4545 mm) long with a sidewall angle of 98 degrees and a mold depth of 0.0315 inch (0.8 mm) arranged in a radial array (all apexes pointing toward the perimeter) except that each cavity also has a conduit that extends away from the working surface of the positioning tool toward a source of reduced pressure. The other difference was that the positioning tool only contained the seven outer circles of triangular-shaped cavities. The positioning tool was filled with the bare SAP4 assisted by tapping. The reduced pressure source was turned on and the positioning tool is turned upside down while maintaining a single particle in the majority of cavities. Shaped abrasive particles in excess of those accommodated into the tool's cavities were removed in this way. The SAP4 abrasive particles (4.5 grams) were transferred to a 123 mm diameter disc of fiberglass mesh RXO 08-123×23 mm, further referred to as a Scrim2, from Rymatex in Rymanów, Poland scrim and held in place by diluted resin as described in Example 1. The resultant abrasive preform consisted of SAP4 attached to Scrim2.

Use of the reduced pressure source enabled the cavities of the positioning tool to be filled faster and better than without the use of a reduced pressure source. In addition, there was less movement of the SAP4 during the transfer from the positioning tool to the scrim when using the reduced pressure source.

An automated Matemini press was used to make the cut-off wheels. One uncoated Scrim2, fiberglass mesh side up, was placed into each of the six mold cavities. A fill mixture (approximately 39 grams) consisting of 1200 grams of AP2, 120 grams of RP and 680 grams of PP was shuttle-boxed on top of the Scrim2. The abrasive preform was placed in the top of the mold cavity with the abrasive particles side down. A 2.625 inch diameter label was placed on top of the abrasive preform followed by a metal flange. The cut-off wheel was molded and cured identically to Example 1. The final thickness of the wheel was 0.068-inch (1.73-mm). Three shuttlebox cycles were made of Example 6 for a total of 18 samples. Three samples were tested.

Example 7

Example 7 was prepared identically to Example 6 except that the scrim used to make the abrasive preform was a 123 mm diameter disc of fiberglass mesh with a polyethylene film attached to the bottom side. One shuttlebox cycle was made of Example 7 for a total of 6 samples. Two samples were tested.

Comparative Example A

Example 1 was repeated, except that no shaped abrasive particles were placed on either scrim, and the fill mixture was 31 grams of a mixture of 200 grams of SAP2, 400 grams of SAP3, 60 grams of RP, 1.2 grams SCP and 340 grams of PP. Also, the wheel had a label. Three replicates of Comparative Example A were made for a total of four samples.

Comparative Example B

Example 1 was repeated, except that no SAP was placed on either scrim, and the fill mixture was 31 grams of a mixture of 200 g of SAP2, 400 g of SAP3, 60 g of RP, 1.2 g SCP and 340 g of PP. In addition, a shorter 24 hour cure cycle was used to cure the wheels: 2 hours at 75° C., 2 hours at 90° C., 5 hours at 110° C., 3 hours at 135° C., 3 hours at 188° C., 7 hours at 188° C., and a 2 hour cool-down to 60° C. Three replicates of Comparative Example B were made for a total of four samples.

Comparative Example C

The abrasive article of Comparative Example C was prepared identically to Example 1, except that no SAP was placed on either scrim, and the fill mixture was 26 grams of a mixture made with 650 grams of AP1, 55 grams of RP and 295 grams of PP. A replicate of Comparative Example C was made for a total of 2 samples.

Comparative Example D

The abrasive article of Comparative Example D was prepared identically to Example 1, except that no SAP was placed on either scrim, and the fill mixture was 26 grams of a mixture containing 3.3 grams SCA, 165 grams of RP, 1950 grams of SAP1 and 885 grams of PP as made in Example 1. A replicate of Comparative Example D was made for a total of 2 samples.

Comparative Example E

The abrasive article of Comparative Example E was prepared identically to Comparative Example D, except that the fill mixture was 41 grams of a mixture containing 1.1 grams SCA, 55 grams of RP, 650 grams of SAP1 and 295 grams of PP as made in Example 1. The final thickness of the wheel was 0.070-inch (1.78-mm). Two replicates of Comparative Example D were made for a total of 3 samples.

Comparative Example F

Example 6 was repeated, except that no shaped abrasive particles were placed on either scrim, and the fill mixture was approximately 40 grams of a mixture consisting of 1200 grams of AP2, 120 grams of RP and 680 grams of PP. Two shuttlebox cycles were made of Comparative Example F for a total of 12 samples. Two samples were tested.

Table 2, below, lists results obtained according to the CUTTING TEST METHOD for various of the above Examples.

TABLE 2

| EXAMPLE | CUT RATE, inches/minute (cm/min) | WEAR RATE, $cm^3$/minute |
|---|---|---|
| 1 | 36.0, 43.6, 37.5, 41.4, 39.5 (91.4, 111, 95.3, 105, 100) | 6.3, 7.8, 8.2, 6.0, 7.9 |
| 2 | 34.3 (87.1) | 8.0 |
| 3 | 29.0 (73.7) | 6.8 |
| 5 | 28.9, 26.9, 26.5 (73.4, 68.3, 67.3) | 1.8, 1.6, 2.1 |
| 6 | 27.5, 27.9, 26.8 (69.9, 70.8, 67.9) | 2.1, 2.0, 2.1 |
| 7 | 20.9, 19.8 (53.6, 50.2) | 2.1, 2.1 |
| Comparative Example A | 34.0, 33.3, 36.6, 34.8 (86.4, 84.6, 93.0, 88.4) | 6.8, 6.0, 6.0, 7.3 |
| Comparative Example B | 37.5, 39.3, 38.1, 39.4 (95.3, 99.8, 96.8, 100) | 6.3, 4.3, 5.0, 4.5 |
| Comparative Example C | 46.6, 47.0 (118, 119) | 8.3, 7.7 |
| Comparative Example D | 48.5, 53.9 (123, 137) | 21.3, 7.4 |
| Comparative Example E | 33.0, 31.4, 34.1 (83.8, 79.8, 86.6) | 0.7, 0.4, 0.8 |
| Comparative Example F | 25.9, 26.8 (65.7, 67.9) | 1.9, 2.0 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of making an abrasive article, the method comprising the sequential steps:

a) providing a positioning tool having a working surface with cavities formed therein, wherein the cavities are arranged on the working surface according to a pattern and orientation;

b) making an abrasive preform comprising shaped abrasive particles adhered to a first reinforcing member having opposed front and back surfaces, and wherein the abrasive preform is made by a method comprising:

i) disposing the shaped abrasive particles in at least some of the cavities of the positioning tool;

ii) transferring the shaped abrasive particles to the first reinforcing member that shaped abrasive particles are disposed proximate to the front surface of the first reinforcing member according to the pattern of the cavities;

iii) adhering the transferred shaped abrasive particles to the front surface of the first reinforcing member; and iv) depositing a space-filling binder precursor on the first reinforcing member and transferred shaped abrasive particles such that space between the shaped abrasive particles is at least partially filled with the space-filling binder precursor;

c) disposing a second reinforcing member on the abrasive preform wherein the front surface of the first reinforcing member faces said second reinforcing member to provide an abrasive article precursor; and d) compressing and curing the abrasive article precursor to form the abrasive article.

2. The method of claim 1, wherein in step i) the shaped abrasive particles have a particulate binder precursor disposed on at least a portion of their surfaces.

3. The method of claim 2, wherein the particulate binder precursor is disposed on the shaped abrasive particles by a method comprising:

depositing a thin coating of a liquid binder precursor on the surface of the shaped abrasive particles; and then adhering the particulate binder precursor to the thin coating of a liquid binder precursor.

4. The method of claim 1, wherein in step i) the front surface of the reinforcing member has a curable adhesive precursor disposed on at least a portion thereof.

5. The method of claim 1, wherein the predetermined pattern and orientation of the cavities has a rotational axis of symmetry, and wherein the cavities are arranged in radially overlapping circumferential rows.

6. The method of claim 1, wherein the shaped abrasive particles comprise precisely-shaped abrasive particles, wherein the precisely-shaped abrasive particles comprise a base and a top connected by a plurality of sidewalls, and wherein the respective bases of the precisely-shaped abrasive particles are aligned substantially parallel to the back of the abrasive preform.

7. The method of claim 1, wherein a majority of the cavities have planar bottoms parallel to the working surface of the positioning tool.

8. The method of claim 1, wherein at least some of the cavities comprise conduits that extend away from the working surface of the positioning tool toward a source of reduced pressure.

9. A method of making an abrasive article, the method comprising the sequential steps:

a) providing a positioning tool having a working surface with cavities formed therein, wherein the cavities are arranged on the working surface according to a pattern;

b) making a plurality of abrasive preforms, wherein each abrasive preform respectively comprises shaped abrasive particles adhered to a first reinforcing member, and wherein each abrasive preform is respectively made by a method comprising:

i) disposing shaped abrasive particles in at least some of the cavities of the positioning tool;

ii) transferring the shaped abrasive particles to a first reinforcing member having front and back surfaces such that shaped abrasive particles are disposed on the front surface of the first reinforcing member according to the pattern of the cavities;

iii) adhering the transferred shaped abrasive particles to the front surface of the first reinforcing member;

iv) depositing a space-filling binder precursor onto the first reinforcing member and transferred shaped abrasive particles such that space between shaped abrasive particles is at least partially filled with the space-filling binder precursor;

d) forming a stack comprising the plurality of abrasive preforms, wherein the stack has a top and a bottom, thereby providing an abrasive article precursor; and e) curing the abrasive article precursor while compressing the plurality of abrasive preforms together to form the abrasive article.

10. The method of claim 9, wherein in step i) the shaped abrasive particles have a particulate binder precursor disposed on at least a portion of their surfaces.

11. The method of claim 10, wherein the particulate binder precursor is disposed on the shaped abrasive particles by a method comprising:

depositing a thin coating of a liquid binder precursor on the surface of the shaped abrasive particles; and then adhering the particulate binder precursor to the thin coating of a liquid binder precursor.

12. The method of claim 9, wherein the cavities have predetermined shapes, and wherein the cavities are arranged on the working surface according to a predetermined pattern and orientation.

13. The method of claim 9, wherein taken collectively the predetermined pattern and orientation of the cavities has a rotational axis of symmetry, and wherein the cavities are arranged in radially overlapping circumferential rows.

14. The method of claim 9, wherein the shaped abrasive particles comprise precisely-shaped abrasive particles, wherein the precisely-shaped abrasive particles comprise truncated pyramids comprising a base and a top connected by a plurality of sloping sidewalls, and wherein the respective bases of the precisely-shaped abrasive particles are aligned substantially parallel to each other.

15. The method of claim 9, wherein a majority of the cavities have planar bottoms parallel to the working surface of the positioning tool.

16. The method of claim 9, wherein at least some of the shaped abrasive particles comprise precisely-shaped abrasive particles.

17. The method of claim 9, wherein the cavities comprise conduits that extend away from the working surface of the positioning tool toward a source of reduced pressure.

18. An abrasive wheel comprising precisely-shaped abrasive particles retained in an organic binder material, wherein the abrasive wheel comprises two sides contacting a peripheral surface, wherein the abrasive wheel has a rotational axis extending through its center, wherein at least a portion of the precisely-shaped abrasive particles are disposed in the organic binder material according to a predetermined three-dimensional position and orientation, wherein the precisely-shaped abrasive particles comprise a base and a top connected by a plurality of sidewalls, and wherein the respective bases of the shaped abrasive particles are aligned substantially perpendicular to the rotational axis.

19. The bonded abrasive wheel of claim 18, wherein the precisely-shaped abrasive particles comprise truncated pyramids.

20. The bonded abrasive wheel of claim 18, wherein taken collectively the predetermined three-dimensional position and orientation of the precisely-shaped abrasive particles is rotationally symmetric about the rotational axis, and wherein the precisely-shaped abrasive particles cavities are arranged in radially overlapping circumferential rows.

* * * * *